US011767631B2

(12) United States Patent
Jo et al.

(10) Patent No.: US 11,767,631 B2
(45) Date of Patent: Sep. 26, 2023

(54) WASHING MACHINE

(71) Applicant: Samsung Electronics Co., Ltd., Suwon-si (KR)

(72) Inventors: Geonhui Jo, Suwon-si (KR); Wonseok Choi, Suwon-si (KR); Doyun Lee, Suwon-si (KR); Janghoon Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 132 days.

(21) Appl. No.: 17/109,392

(22) Filed: Dec. 2, 2020

(65) Prior Publication Data

US 2021/0164148 A1 Jun. 3, 2021

(30) Foreign Application Priority Data

Dec. 2, 2019 (KR) ..... 10-2019-0158515

(51) Int. Cl.
*D06F 39/02* (2006.01)
*D06F 39/08* (2006.01)

(52) U.S. Cl.
CPC ..... *D06F 39/02* (2013.01); *D06F 39/088* (2013.01)

(58) Field of Classification Search
CPC ..... D06F 39/02; D06F 39/088
USPC ..... 68/17 R
See application file for complete search history.

(56) References Cited

U.S. PATENT DOCUMENTS

| | | | | |
|---|---|---|---|---|
| 4,444,730 | A * | 4/1984 | Renders | D06F 39/02 134/93 |
| 6,434,977 | B1 | 8/2002 | Hapke et al. | |
| 10,648,121 | B2 | 5/2020 | Bronn et al. | |
| 2009/0053119 | A1 | 2/2009 | Richman et al. | |
| 2017/0021312 | A1* | 1/2017 | Schwartz | B01F 21/15 |
| 2018/0363222 | A1* | 12/2018 | Gim | D06F 39/022 |
| 2019/0024280 | A1 | 1/2019 | Lee et al. | |

FOREIGN PATENT DOCUMENTS

| | | |
|---|---|---|
| CN | 106319873 | 1/2017 |
| EP | 3323926 | 5/2018 |
| JP | 2003-24687 | 1/2003 |

(Continued)

OTHER PUBLICATIONS

CN106319873A—machine translation (Year: 2017).*

(Continued)

*Primary Examiner* — Tinsae B Ayalew
(74) *Attorney, Agent, or Firm* — STAAS & HALSEY LLP

(57) ABSTRACT

Disclosed is a washing machine including a detergent supply device capable of preventing a detergent and water from overflowing to the outside of a detergent container. The washing machine includes a main body, a tub disposed in the main body, and a detergent supply device configured to supply a detergent to the tub and to receive water at a position lower than a level of the detergent contained in the detergent supply device, wherein the detergent supply device includes a first outlet configured to increase the time it takes for the detergent put in the detergent supply device to be discharged to the outside of the detergent supply device, and a second outlet configured to discharge the detergent put in the detergent supply device and water introduced into the detergent supply device through an inlet.

14 Claims, 13 Drawing Sheets

(56) References Cited

FOREIGN PATENT DOCUMENTS

| | | | |
|---|---|---|---|
| JP | 4374375 | B2 | 12/2009 |
| JP | 2014-33836 | | 2/2014 |
| JP | 2014-210007 | | 11/2014 |
| KR | 10-2007-0117914 | A | 12/2007 |
| KR | 10-2009-0099809 | A | 9/2009 |
| KR | 10-1375715 | B1 | 3/2014 |
| KR | 10-2014-0131809 | A | 11/2014 |
| KR | 10-2015-0137656 | A | 12/2015 |
| KR | 10-1894881 | | 9/2018 |

OTHER PUBLICATIONS

KR101894881B1—machine translation (Year: 2018).*
International Search Report dated Mar. 29, 2021 in International Patent Application No. PCT/KR2020/017382.

* cited by examiner

WASHING MACHINE

CROSS-REFERENCE TO RELATED APPLICATION(S)

This application is based on and claims priority under 35 U.S.C. § 119 to Korean Patent Application No. 10-2019-0158515, filed on Dec. 2, 2019, in the Korean Intellectual Property Office, the disclosure of which is incorporated by reference herein in its entirety.

BACKGROUND

1. Field

The disclosure relates to a washing machine, and more particularly, to a washing machine including a detergent supply device.

2. Description of Related Art

Generally, a washing machine is a device for washing laundry by rotating a cylindrical rotary tub containing the laundry. As a type of washing machine, there are a drum washing machine in which laundry is washed by falling down after being lifted upward along an inner circumferential surface of a drum as the drum, which is disposed substantially horizontally, rotates with respect to a horizontal axis, and a vertical axis washing machine in which laundry is washed using a water current generated by a pulsator disposed inside a drum as the drum, which is disposed substantially vertically, rotates with respect to a vertical axis.

Generally, a washing machine may include a detergent supply device provided to supply washing water and detergent into a drum. The detergent supply device may include a detergent container for receiving a detergent, and a flow path for guiding water to the detergent container from an external water supply source.

The pressure of water guided to the detergent container from an external water supply source differs depending on the installation environment. When the pressure of water guided to the detergent container is too high, the detergent contained in the detergent container may overflow outside the detergent container together with water that is introduced into the detergent container. The water and detergent overflowing to the outside of the detergent container may cause the washing machine to malfunction. In particular, solid detergents in powder form may overflow outside the detergent container even when the water pressure is relatively weak. For this reason, manufacturers sometimes prohibit putting-in of solid detergents in advance.

SUMMARY

In accordance with an aspect of the disclosure, a washing machine includes a main body, a tub disposed in the main body, and a detergent supply device configured to supply a detergent to the tub and to receive water at a position lower than a level of the detergent contained in the detergent supply device, wherein the detergent supply device includes an inlet through which water is introduced from the outside of the detergent supply device, a first outlet configured to increase the time it takes for the detergent put in the detergent supply device to be discharged to the outside of the detergent supply device, and a second outlet configured to discharge the detergent put in the detergent supply device and water introduced into the detergent supply device through the inlet.

The first outlet may include a first slit extending in a first direction, and a second slit extending in a second direction crossing the first direction to prevent residual water from remaining in the detergent supply device.

When the first slit extends in a horizontal direction and the second slit extends in a vertical direction, a length of the first slit may be longer than a length of the second slit.

The second outlet may be larger than the first outlet and may be disposed higher than the first outlet.

The detergent supply device may further include a detergent container configured to contain the detergent, a housing including a water supply part to receive water from an external water supply source, and configured to guide water supplied through the water supply part to the detergent container, and a housing cover including a detergent container hole into which the detergent container is inserted, and configured to cover an open upper side of the housing.

The detergent container may include the inlet through which water is introduced into the detergent container from the outside of the detergent container, the first outlet configured to increase the time it takes for the detergent contained in the detergent container to be discharged to the outside of the detergent container, and the second outlet formed larger than the first outlet to discharge the detergent contained in the detergent container and water introduced into the detergent container to the outside of the detergent container.

The detergent container may further include a maximum detergent storage level indicating surface indicating the maximum storage level of the detergent contained in the detergent container.

The second outlet may be disposed above the maximum detergent storage level indicating surface.

The detergent container may further include an outlet divider configured to divide the second outlet into a predetermined size or less to prevent foreign matters larger than the predetermined size from being discharged through the second outlet.

The detergent container may further include a distribution guide disposed adjacent to the inlet to guide water introduced into the detergent container through the inlet in two different directions.

The housing cover may further include a first blocking wall configured to block a part of water guided from the water supply part to the inlet.

The detergent container may further include a second blocking wall configured to block a part of water passing through the first blocking wall and introduced into the inlet.

The housing further may further include a first guide wall configured to guide water introduced into the housing through the water supply part to the inlet, and a second guide wall spaced apart from the first guide wall by a predetermined distance.

The detergent contained in the detergent container may be primarily mixed with water introduced into the detergent container through the inlet, and discharged to the outside of the detergent container together with water introduced into the inlet through the second outlet and then mixed secondarily in the housing.

When mixed secondarily in the housing, the detergent discharged into the housing may be mixed with water that has moved into the housing without being introduced into the detergent container from the water supply part.

The detergent container may further include an overflow hole disposed adjacent to the inlet and positioned higher than the maximum detergent storage level indicating surface.

When a solid detergent is put into the detergent container, water introduced into the detergent container through the inlet may be discharged to the outside of the detergent container together with the solid detergent through the overflow hole.

The water and the solid detergent discharged through the overflow hole may be introduced into the detergent container again through the inlet.

In accordance with an aspect of the disclosure, a washing machine includes a main body, a tub disposed in the main body, and a detergent supply device configured to supply a detergent to the tub and including a detergent container in which the detergent is contained and a housing to which water is supplied from the outside of the detergent supply device, wherein the detergent container includes a slit configured to increase the time it takes for the detergent put into the detergent container to be discharged to the outside of the detergent container, and an outlet formed larger than the slit to discharge the detergent contained in the detergent container and water introduced into the detergent container.

The detergent container may further include an inlet through which water is introduced into the detergent container from the outside of the detergent container, and a maximum detergent storage level indicating surface indicating the maximum storage level of the detergent contained in the detergent container.

The outlet may be disposed above the maximum detergent storage level indicating surface.

The detergent container may further include an overflow hole disposed adjacent to the inlet and positioned higher than the maximum detergent storage level indicating surface.

When a solid detergent is put into the detergent container, water introduced into the detergent container through the inlet may be discharged to the outside of the detergent container together with the solid detergent through the overflow hole.

The detergent contained in the detergent container may be primarily mixed with water introduced into the detergent container through the inlet, and discharged to the outside of the detergent container together with water introduced into the inlet through the outlet and then mixed secondarily in the housing.

In accordance with an aspect of the disclosure, a washing machine includes a first cabinet, a second cabinet disposed above the first cabinet, a first tub covered by the first cabinet, a second tub covered by the second cabinet, a first detergent supply device configured to supply a detergent to the first tub, and a second detergent supply device configured to supply the detergent to the second tub, wherein the second detergent supply device includes an inlet through which water is introduced from the outside of the second detergent supply device, a first outlet configured to increase the time it takes for the detergent put in the second detergent supply device to be discharged to the outside of the second detergent supply device, and a second outlet configured to discharge the detergent put in the second detergent supply device and water introduced into the second detergent supply device through the inlet.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
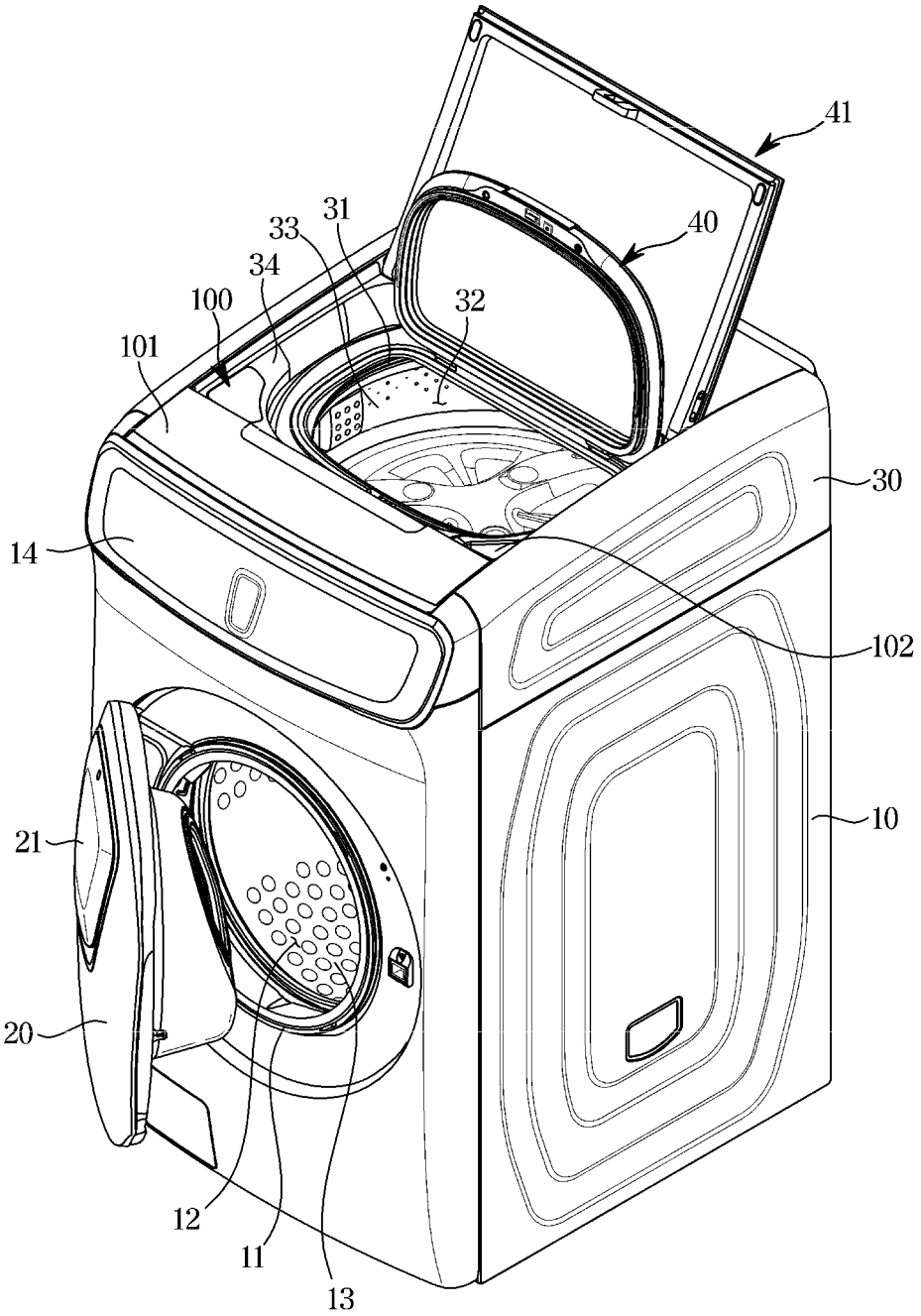
FIG. 1 is a perspective view of a washing machine according to an embodiment of the disclosure.

Configurations shown in the embodiments and the drawings described in the present specification are only the preferred embodiments of the present disclosure, and thus it is to be understood that various modified examples, which may replace the embodiments and the drawings described in the present specification, are possible when filing the present application.

The terms used herein are for the purpose of describing the embodiments and are not intended to restrict and/or to limit the disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that although the terms first, second, etc. may be used herein to describe various components, these components should not be limited by these terms, and the terms are only used to distinguish one component from another. For example, without departing from the scope of the disclosure, the first component may be referred to as a second component, and similarly, the second component may also be referred to as a first component.

The terms "front end," "rear end," "upper portion," "lower portion," "upper end" and "lower end" used in the following description are defined with reference to the drawings, and the shape and position of each component are not limited by these terms.

A washing machine in which a drum is arranged horizontally is referred to as a front loading washing machine because a laundry inlet is formed in the front, and a washing machine in which a drum is arranged vertically is referred to as a top loading washing machine because a laundry inlet is formed at the top.

Hereinafter, embodiments of the disclosure will be described in detail with reference to the accompanying drawings.

Hereinafter, a washing machine including a first washing apparatus and a second washing apparatus will be described as an example, but is not limited thereto. A detergent supply device according to an embodiment of the disclosure may be applied to a front loading washing machine. Also, a detergent supply device according to an embodiment of the disclosure may be applied to a top loading washing machine.

It is an aspect of the disclosure to provide a washing machine including a detergent supply device capable of preventing a detergent and water from overflowing to the outside of a detergent container.

It is another aspect of the disclosure to provide a washing machine including a detergent supply device capable of using a solid detergent as well as a liquid detergent.

It is another aspect of the disclosure to provide a washing machine including a detergent supply device capable of visually recognizing an input amount of detergent to a user by delaying the time that a liquid detergent is discharged to the outside of a detergent container when the liquid detergent is put into the detergent container.

It is another aspect of the disclosure to provide a washing machine including a detergent supply device capable of improving the washing effect by sufficiently mixing a detergent put in a detergent container with water before being supplied into a drum.

Hereinafter, a first outlet may refer to a slit. Also, a second outlet may refer to an outlet.

FIG. 1 is a perspective view of a washing machine according to an embodiment of the disclosure.

As illustrated in FIG. 1, a washing machine 1 may include a first washing apparatus of a front loading type having a first laundry inlet 11 formed in the front thereof, and a second washing apparatus of a top loading type having a second laundry inlet 31 formed at the top thereof.

The washing machine 1 may include a first drum 13 having a first washing space 12 formed therein, and a first tub (not shown) accommodating the first drum 13 therein and storing washing water or rinse water to be used in a washing process or a rinsing process.

The washing machine 1 may include a control panel 14 disposed at a front upper portion of the first housing 10 to operate the washing machine 1. The control panel 14 may include an input (not shown) for receiving an operation command of the washing machine 1 from a user and a display (not shown) for displaying operation information of the washing machine 1.

The washing machine 1 may include a first housing 10 configured to cover the first drum 13 and the first tub. A first door 20 configured to open and dose the first laundry inlet 11 may be coupled to the first housing 10.

The first door 20 may include an auxiliary door 21 so that laundry may be put into the first washing space 12 even when the first door 20 is closed. The auxiliary door 21 may be mounted on the first door 20 so as to be rotatable with respect to the first door 20.

The present embodiment illustrates that the auxiliary door 21 is provided in the first door 20, but is not limited thereto, and the first door 20 may not include the auxiliary door 21.

The washing machine 1 may include a second drum 33 in which a second washing space 32 is formed, and a second tub (not shown) accommodating the second drum 33 therein and storing washing water or rinse water to be used in the washing process or rinsing process. The second drum 33 and the second tub may be formed in a cylindrical shape in which at least a portion of one surface thereof is open, and the open surface may be disposed to face substantially upward.

The washing machine 1 may include a second drum 33 and a second housing 30 configured to cover the second drum 33. The second housing 30 may accommodate the second tub (not shown) therein.

The washing machine 1 may include a second door 40 provided at the second housing 30 to open and close the second laundry inlet 31. The second door 40 may be provided to correspond to the second laundry inlet 31.

The washing machine 1 may include a cover door 41 configured to cover an upper surface of the washing machine 1 when the second door 40 is closed. By closing the cover door 41, an outer appearance of the washing machine 1 may be maintained neatly during the washing process.

The second drum 33 may be provided in a cylindrical shape with an open upper side and may be disposed to be rotatable inside the second tub (not shown).

The washing machine 1 may include detergent supply devices 101 and 100 configured to supply a detergent to the first tub (not shown) and the second tub (not shown), respectively. The detergent supply devices 101 and 100 may include the first detergent supply device 101 configured to supply the detergent to the first tub and the second detergent supply device 100 configured to supply the detergent to the second tub.

The first detergent supply device 101 may be provided in the second housing 30. Specifically, the first detergent supply device 101 may be provided on a frame 34 forming the second laundry inlet 31 inside the second housing 30. Appropriately, the first detergent supply device 101 may be disposed in front of the second laundry inlet 31.

The second detergent supply device 100 may be disposed in the second housing 30. The second detergent supply device 100 may be disposed at a left edge of the frame 34. At a right edge of the frame 34, an auxiliary additive supply device 102 configured to receive a fabric softener and/or bleach and to supply the fabric softener and/or bleach to the second tub may be disposed. The positions of the second detergent supply device 100 and the auxiliary additive supply device 102 may be interchanged.

The second detergent supply device 100 may be covered by the cover door 41. The second detergent supply device 100 may be disposed to be accessible to a user as the cover door 41 is opened.

Figure 2:
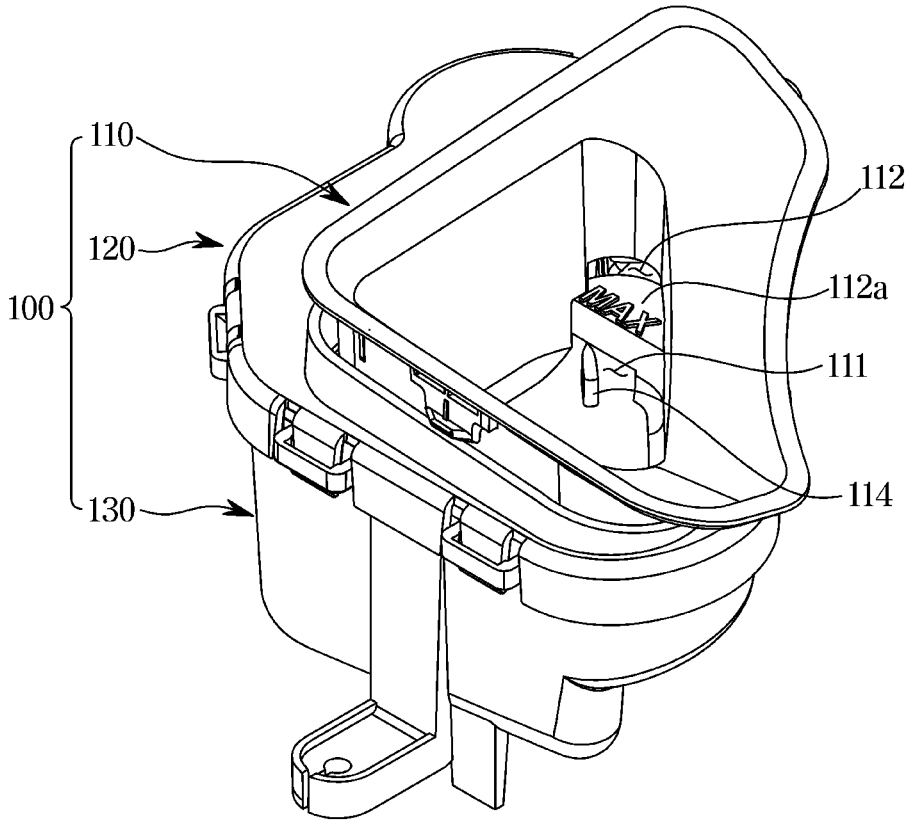
FIG. 2 is a perspective view of a detergent supply device in the washing machine according to an embodiment of the disclosure.
Figure 3:
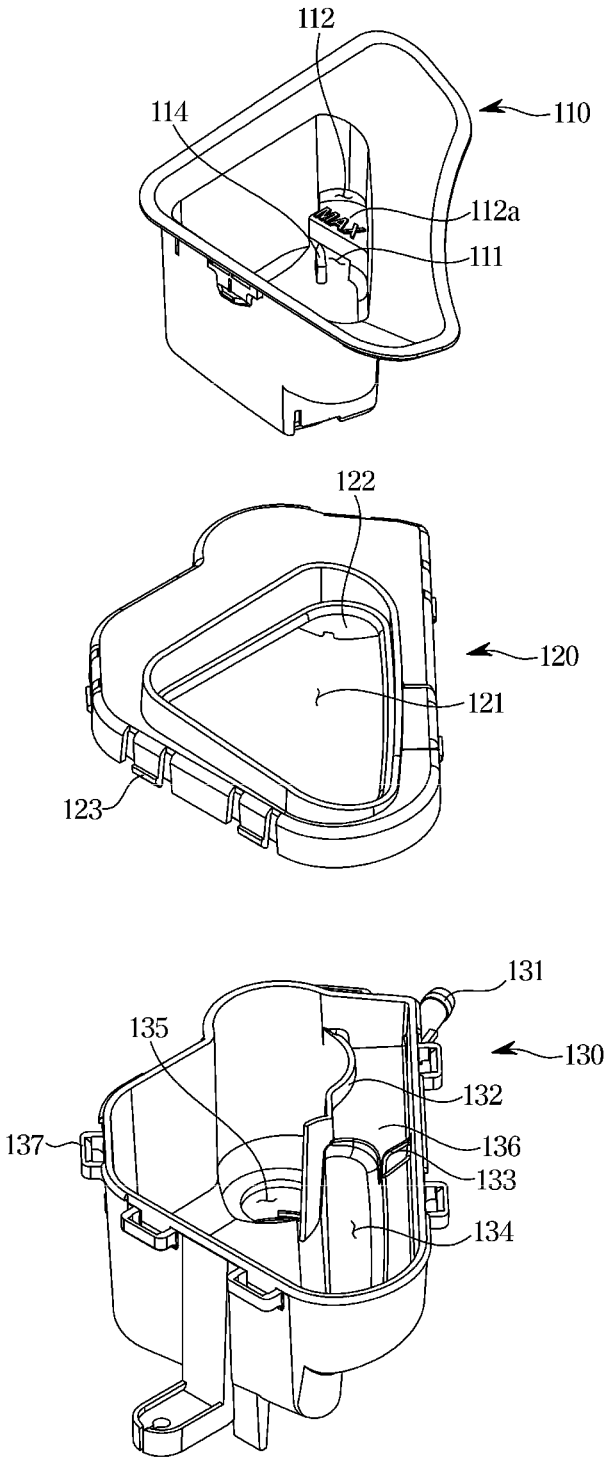
FIG. 3 is an exploded perspective view of the detergent supply device shown in FIG. 2.

FIG. 2 is a perspective view of a detergent supply device in the washing machine according to an embodiment of the disclosure, and FIG. 3 is an exploded perspective view of the detergent supply device shown in FIG. 2.

Hereinafter, the second detergent supply device 100 will be described in detail. For convenience of explanation, the second detergent supply device 100 will be referred to as a detergent supply device. In addition, it is notified in advance that the first housing 10 and the second housing 30 have a configuration different from that of a housing 130, which will be described later.

Referring to FIGS. 2 and 3, the detergent supply device 100 according to an embodiment of the disclosure may include a detergent container 110 in which the detergent is received, the housing 130 for discharging the detergent and water discharged from the detergent container 110 to the outside of the detergent supply device 100, and a housing cover 120 configured to cover an upper surface of the housing 130.

A detergent may be supplied to the detergent container 110. An upper side of the detergent container 110 may be opened. The user may put the detergent through the open upper side of the detergent container 110. A lower surface of the detergent container 110 may be formed to be inclined toward a slit 115, which will be described later.

The housing 130 may include a water supply part 131 connected to a hose (not shown) that guides water from an external water supply source (not shown). Water guided through the hose from the external water supply source through the water supply part 131 may be introduced into the housing 130. The housing 130 may include a first guide wall 132 and a second guide wall 133 to guide water introduced into the housing 130. The housing 130 may include a detergent container groove 134 in which at least a portion of the detergent container 110 is inserted. Also, the housing 130 may include a discharge part 135 to discharge the detergent and water introduced into the housing 130 to the outside of the housing 130.

The housing cover 120 may be configured to cover an open upper side of the housing 130. The housing cover 120 may include a detergent container hole 121 formed such that the detergent container 110 is inserted therein. The housing cover 120 may include a first blocking wall 122 configured to block a part of water introduced into the housing 130 from the water supply part 131 from flowing into the detergent container 110.

The housing cover 120 may include a plurality of coupling protrusions 123 disposed to be spaced apart from each other along a circumference of the housing cover 120. The housing 130 may include a plurality of protrusion accommodating portions 137 disposed to be spaced apart from each other along the circumference of the housing 130 so as to correspond to each of the plurality of coupling protrusions 123. When each of the plurality of coupling protrusions 123 is elastically deformed to be accommodated in each of the plurality of protrusion accommodating portions 137, the housing cover 120 may be coupled to the housing 130. Unlike shown in the drawings, the plurality of protrusion accommodating portions 137 may be provided on the housing cover 120, and the plurality of coupling protrusions 123 may be provided on the housing 130. Also, the housing cover 120 and the housing 130 may be coupled using a structure different from the coupling protrusions 123 and the protrusion accommodating portions 137.

According to an embodiment of the disclosure, the detergent supply device 100 may not use siphonage. In order to use the siphonage, water needs to be supplied to the detergent container from a position higher than a maximum detergent storage level in the detergent container. According to an embodiment of the disclosure, a height of the water supply part 131 from which water is supplied to the detergent supply device 100 may be lower than a height of a maximum detergent storage level indicating surface 112*a* of the detergent container 110. Because water is supplied to the detergent container 110 from a position lower than the maximum detergent storage level, it is difficult to supply the detergent using the siphonage. Accordingly, the detergent supply device 100 according to an embodiment of the disclosure may supply the detergent to the tub without using the siphonage.

Figure 4:
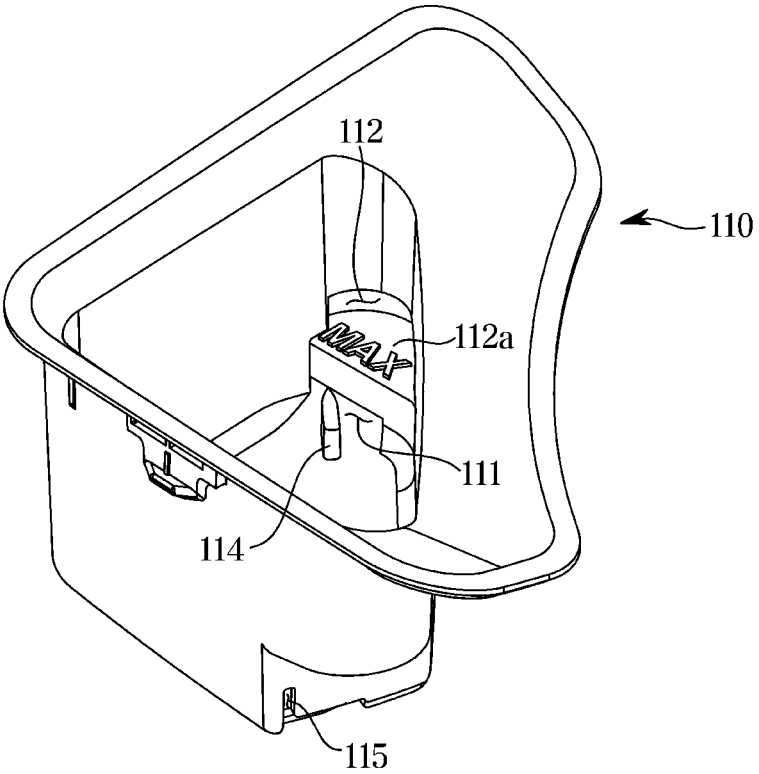
FIG. 4 is a perspective view of a detergent container viewed from one direction in the washing machine according to an embodiment of the disclosure.
Figure 5:
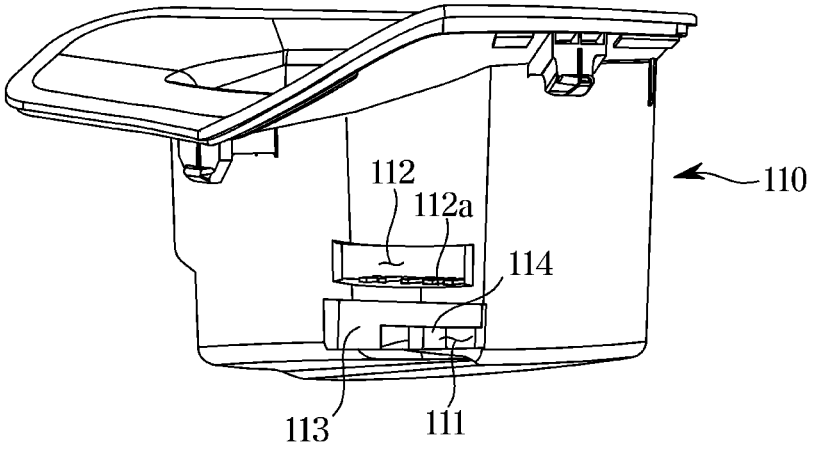
FIG. 5 shows the detergent container of FIG. 4 viewed from another direction.
Figure 6:
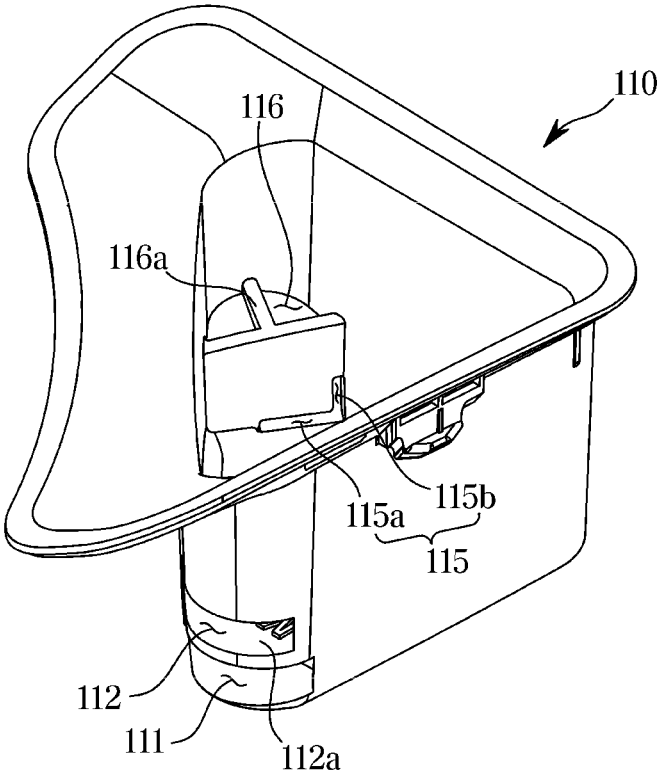
FIG. 6 shows the detergent container of FIG. 4 viewed from another direction.
Figure 7:
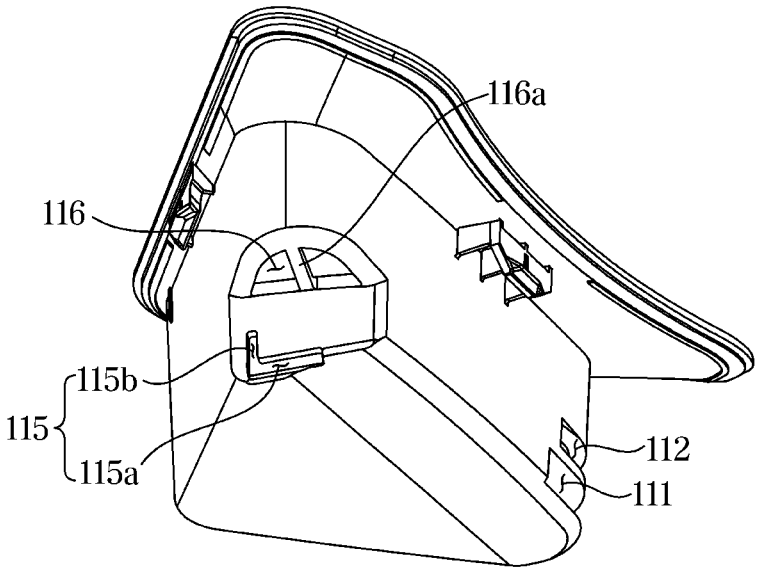
FIG. 7 shows the detergent container of FIG. 4 viewed from another direction.

FIG. 4 is a perspective view of a detergent container viewed from one direction in the washing machine according to an embodiment of the disclosure, FIG. 5 shows the detergent container of FIG. 4 viewed from another direction, FIG. 6 shows the detergent container of FIG. 4 viewed from another direction, and FIG. 7 shows the detergent container of FIG. 4 viewed from another direction.

Hereinafter, a detergent container according to an embodiment of the disclosure will be described in detail with reference to FIGS. 4 to 7.

Referring to FIGS. 4 and 5, the detergent container 110 may include an inlet 111 through which water is introduced into the detergent container 110 from the outside of the detergent container 110, and an overflow hole 112 formed above the inlet 111 to prevent water overflow. The detergent container 110 may include the maximum detergent storage level indicating surface 112*a* disposed adjacent to the overflow hole 112 and indicating the maximum detergent storage level. For example, as shown in the drawings, in order to indicate the maximum detergent storage level, a character "MAX" may be displayed on the maximum detergent storage level indicating surface 112*a*. Also, the detergent container 110 may include a second blocking wall 113 configured to adjust the amount of water introduced into the inlet 111.

The detergent container 110 may include a distribution guide 114 configured to distribute water introduced into the detergent container 110 through the inlet 111. The distribution guide 114 may be disposed adjacent to the inlet 111. The distribution guide 114 may guide a part of water introduced through the inlet 111 to one direction and may guide the remaining part of water to a direction different from the one direction. Through this, water introduced into the detergent container 110 through the inlet 111 may be evenly distributed into the detergent container 110. As water introduced into the detergent container 110 is evenly distributed, the detergent contained in the detergent container 110 and the water introduced into the detergent container 110 may be prevented from overflowing to the outside of the detergent container 110.

According to an embodiment of the disclosure, the detergent container 110 may include the overflow hole 112 adjacent to the inlet 111 and disposed above the maximum detergent storage level indicating surface 112*a*, The overflow hole 112 may prevent water introduced into the detergent container 110 from being discharged to a place other than an outlet 116 when a solid detergent of powder form is put into the detergent container 110. According to an embodiment of the disclosure, the detergent supply device 100 may prevent water overflow from the detergent container 110 even when a solid detergent in powder form is put into the detergent container 110, by including the overflow hole 112. Therefore, the user may use not only a liquid detergent but also a solid detergent in powder form. The user may optionally use a solid detergent and a liquid detergent.

When a solid detergent is put into the detergent container 110 without providing the overflow hole 112, water introduced through the inlet 111 does not move toward the outlet 116 but moves to an upper side of the inlet 111. The water introduced into the detergent container 110 through the inlet 111 is mixed with the solid detergent and may form an arbitrary flow path. In general, water introduced into the inlet 111 forms a flow path toward the upper side from the inlet 111, and through this flow path, the detergent and water may overflow to the outside through the open upper side of the detergent container 110.

According to an embodiment of the disclosure, as the detergent container 110 includes the overflow hole 112 adjacent to the inlet 111 and disposed above the maximum detergent storage level indicating surface 112*a*, even when a solid detergent is put into the detergent container 110, water and the detergent may be prevented from overflowing through the open upper side of the detergent container 110. When the overflow hole 112 is disposed below the maximum detergent storage level indicating surface 112*a*, a liquid detergent is discharged to the outside of the detergent container 110 through the overflow hole 112 before reaching the maximum detergent storage level. The overflow hole 112 may form a recovery flow path. The water introduced into the inlet 111 may move to the upper side of the inlet 111 and be discharged to the outside of the detergent container 110 along with the detergent through the overflow hole 112. The water and detergent discharged through the overflow hole 112 may be introduced into the detergent container 110 through the inlet 111 again. The solid detergent may be sufficiently mixed with water by the recovery flow path formed by the overflow hole 112 to become a liquid state. Most of the detergent in a liquid state sufficiently mixed with water may be discharged to the outside of the detergent container 110 through the outlet 116, like a liquid detergent, which will be described later. The remaining part of the detergent that is not discharged through the outlet 116 may be discharged to the outside of the detergent container 110 through the slit 115.

Referring to FIGS. 6 and 7, the detergent container 110 may include the slit 115 provided to increase the time it takes for the detergent put in the detergent container 110 to be discharged to the outside of the detergent container 110, and the outlet 116 disposed above the slit 115 to allow the detergent and water inside the detergent container 110 to be discharged to the outside of the detergent container 110.

The slit 115 may allow a liquid detergent put in the detergent container 110 to be discharged to the outside of the detergent container 110. The slit 115 may increase the time it takes for a liquid detergent to be discharged to the outside of the detergent container 110 through the slit 115 while allowing the liquid detergent having a higher viscosity than water to be discharged to the outside of the detergent container 110. The slit 115 may be provided smaller than the outlet 116. Also, the slit 115 may be formed to have a narrow width. Because the width of the slit 115 is narrow, it takes a lot of time for a liquid detergent having a high viscosity to pass through the slit 115 and be discharged to the outside of the detergent container 110.

When a liquid detergent is put into the detergent container 110, the liquid detergent may be slowly discharged to the outside of the detergent container 110 by the slit 115. Accordingly, the user may visually recognize the amount of detergent input. The user puts a detergent up to the maximum detergent storage level indicating surface 112*a*, so that an appropriate amount of detergent required for washing may be put into the detergent container 110. As the height of the maximum detergent storage level indicating surface 112*a* is adjusted when the detergent container 110 is designed, an appropriate amount of detergent required for washing may be adjusted.

Because a conventional detergent container only include a wide outlet, when a liquid detergent is put into the detergent container, the detergent is immediately discharged to the outside of the detergent container through the outlet. That is, the liquid detergent is discharged to the outside of the detergent container at the same time as it is put into the detergent container. Therefore, the user may not visually check the amount of liquid detergent put into the detergent container. Accordingly, the amount of detergent that the user puts in the detergent container is different each time, and it is difficult to meet the amount of detergent required for washing.

On the other hand, when a liquid detergent is put into up to the maximum detergent storage level indicating surface 112*a*, the liquid detergent may be discharged to the outside of the detergent container 110 through the inlet 111 rather than the slit 115. As described above, the second blocking wall 113 may be provided around the inlet 111 to adjust the amount of water introduced into the inlet 111. The second blocking wall 113 may block not only a part of water introduced into the inlet 111 from the outside of the detergent container 110 but also may block a part of the liquid detergent put in the detergent container 110 from being discharged to the outside of the detergent container 110 through the inlet 111. In other words, the time it takes for the liquid detergent inside the detergent container 110 to be discharged to the outside of the detergent container 110 through the inlet 111 may be increased due to the second blocking wall 113. Therefore, it may take a long enough time for the liquid detergent put in the detergent container 110 to be discharged to the outside of the detergent container 110 through the slit 115 and the inlet 111. Accordingly, the detergent may be put into up to the maximum detergent storage level indicating surface 112*a* by the user, and the amount of the put detergent may be visually recognized by the user. The user may put only an appropriate amount of detergent required for washing into the detergent container 110 by filling the detergent up to the maximum detergent storage level indicating surface 112*a* according to the intention of the designer. Accordingly, waste of detergent due to an excessively put detergent may be reduced, and a decrease in washing efficiency due to a too little detergent may also be prevented.

The slit 115 may include a first slit 115*a* extending in a first direction and a second slit 115*b* extending in a second direction crossing the first direction. For example, the slit 115 may include the first slit 115*a* extending in a horizontal direction and the second slit 115*b* extending in a vertical direction. A length of the first slit 115*a* extending in the horizontal direction may be longer than a length of the second slit 115*b* extending in the vertical direction.

As the slit 115 includes the first slit 115*a* and the second slit 115*b*, residual water may be prevented from remaining in the detergent container 110. As described above, the slit 115 may have a narrow width in order to reduce the discharge rate of a liquid detergent. However, when the width of the slit 115 is narrow, the residual water inside the detergent container 110 may not be discharged to the outside of the detergent container 110 due to surface tension. When the slit 115 includes the second slit 115*b* extending in the vertical direction, water formed on the second slit 115*b* may be affected by gravity, so that the surface tension may be broken. When the surface tension of water formed on the slit 115 is broken by the second slit 115*b*, the residual water inside the detergent container 110 may be discharged through the slit 115. Therefore, the residual water inside the detergent container 110 may be discharged through the slit 115, and the residual water may be prevented from being collected in the detergent container 110.

The detergent container 110 may include the outlet 116 formed above the slit 115. The outlet 116 may be provided such that an upper side is opened. The detergent container 110 may further include an outlet divider configured to divide the outlet 116 into a predetermined size or less to prevent foreign matters larger than the predetermined size from being discharged through the outlet 116. The outlet divider may be provided in various forms. For example, the outlet divider may include a bar 116*a* across the outlet 116. The bar 116*a* may prevent foreign matters from being discharged through the outlet 116 by dividing the discharge port 116. A plurality of the bars 116*a* may be provided depending on the size of the outlet 116. The outlet divider may include a filtering net covering the outlet 116 as a structure different from the bar 116*a*.

The outlet 116 may be provided to discharge a detergent contained in the detergent container 110 to the outside of the detergent container 110. As described above, a part of the detergent may be discharged through the slit 115, but because the slit 115 is provided to prevent residual water from remaining inside the detergent container 110, the detergent may not be sufficiently discharged through the slit 115. The outlet 116 may discharge water introduced into the detergent container 110 and the detergent contained in the detergent container 110. As described above, because the outlet 116 has a sufficiently large size unlike the slit 115, the detergent and water may be smoothly discharged through the outlet 116.

When water is introduced into the detergent container 110 through the inlet 111, the water level inside the detergent container 110 rises due to the inflow of water. When the level of detergent and water rises, the detergent and water may be discharged to the outside of the detergent container 110 through the outlet 116. The detergent and water discharged through the outlet 116 may move into the housing 130 and be discharged to the outside of the housing 130 through the discharge part 135. The water and detergent discharged through the discharge part 135 may be transferred to the tub and may be introduced into the drum during the washing process.

The outlet 116 may be provided at a position higher than the maximum detergent storage level indicating surface 112*a*. This is because when the outlet 116 is located below the maximum detergent storage level indicating surface 112*a*, the detergent is discharged to the outside of the detergent container 110 through the outlet 116 before reaching the maximum detergent storage level.

Figure 8:
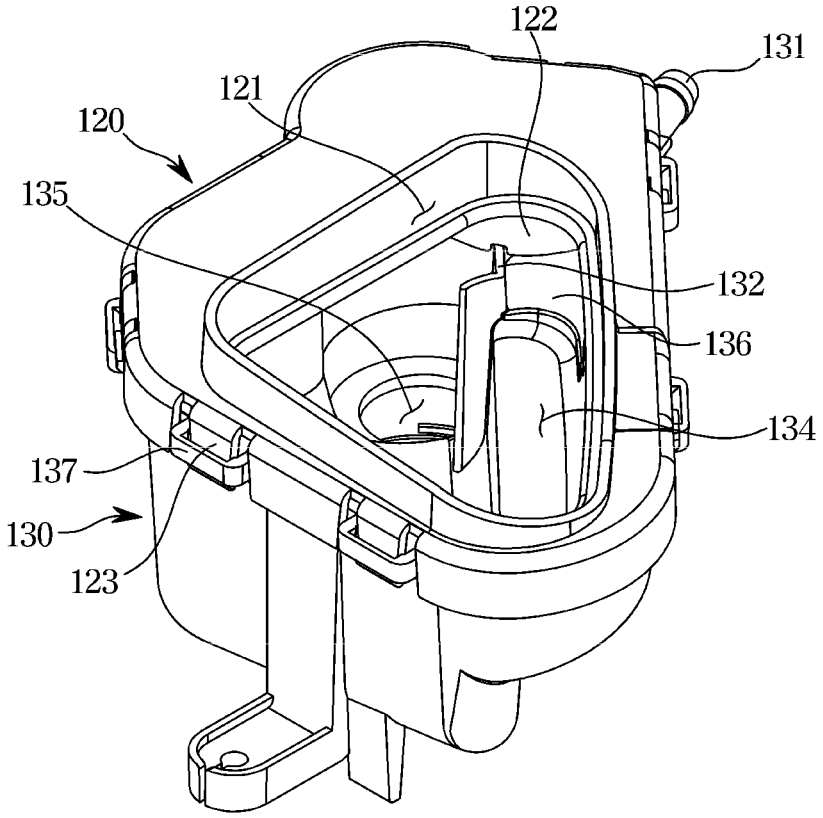
FIG. 8 is a perspective view of the detergent supply device from which the detergent container is removed, in the washing machine according to an embodiment of the disclosure.
Figure 9:
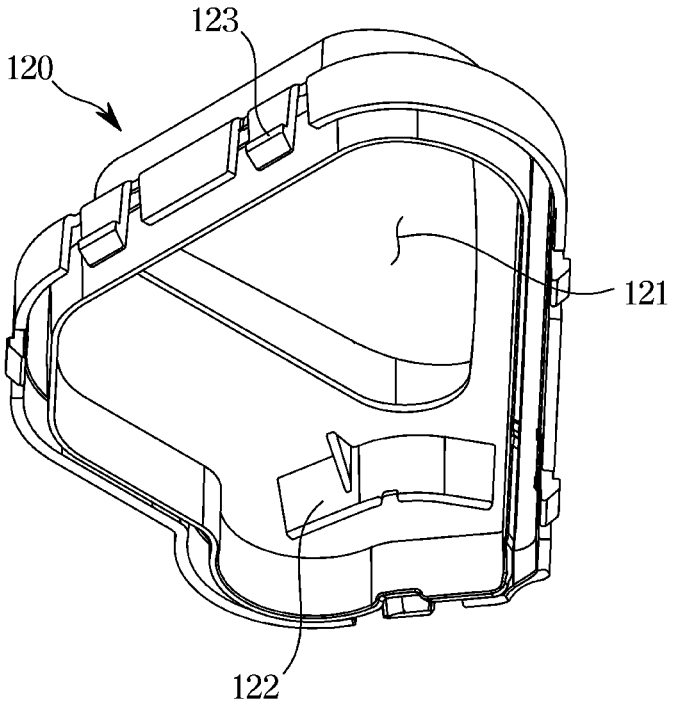
FIG. 9 is a bottom perspective view of a housing cover in the washing machine according to an embodiment of the disclosure.
Figure 10:
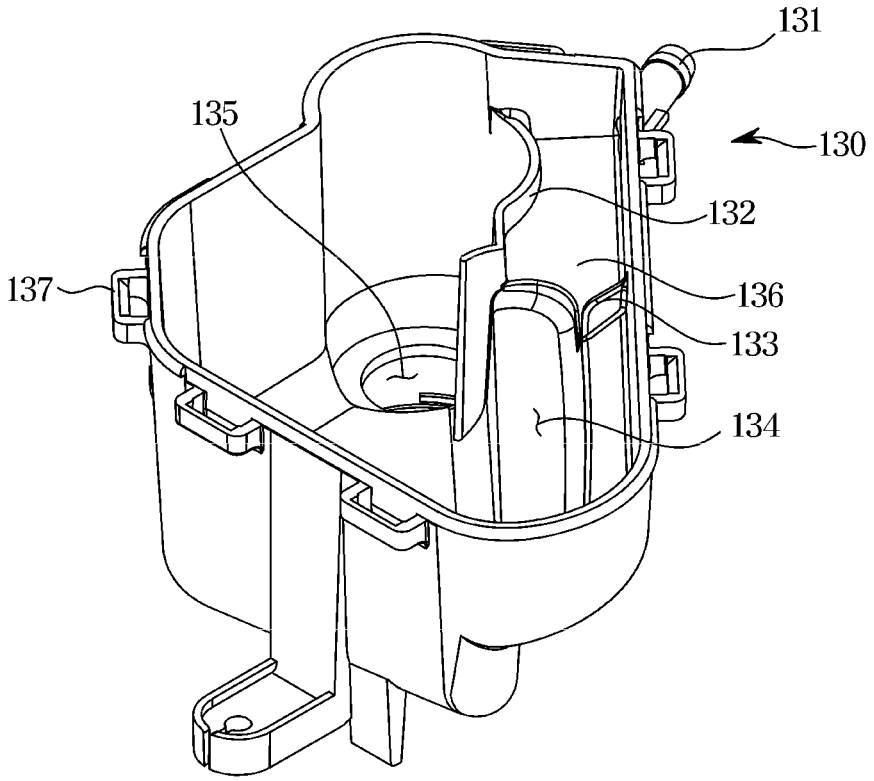
FIG. 10 is a perspective view of a housing of the detergent supply device in the washing machine according to an embodiment of the disclosure.

FIG. 8 is a perspective view of the detergent supply device from which the detergent container is removed, in the washing machine according to an embodiment of the disclosure, FIG. 9 is a bottom perspective view of a housing cover in the washing machine according to an embodiment of the disclosure, and FIG. 10 is a perspective view of a housing of the detergent supply device in the washing machine according to an embodiment of the disclosure.

Hereinafter, a housing and a housing cover of a detergent supply device according to an embodiment of the disclosure will be described in detail with reference to FIGS. 8 to 10.

Referring to FIGS. 8 and 9, the housing cover 120 may be coupled to the housing 130. The housing cover 120 may include the detergent container hole 121 into which the detergent container 110 is inserted. The housing cover 120 may cover the open upper side of the housing 130 except for the detergent container hole 121.

The housing cover 120 may include the first blocking wall 122 extending downward from a lower surface of the housing cover 120. The first blocking wall 122 may primarily block a part of water introduced through the water supply part 131. In other words, when high-pressure water is introduced into the housing 130 through the water supply part 131, the first blocking wall 122 may allow only a part of the introduced water to be introduced into the detergent container 110. The first blocking wall 122 may reduce a gap between the housing cover 120 and a guide bottom wall 136 of the housing 130. The water passed through the gap may be introduced into the detergent container 110 through the second blocking wall 113 and the inlet 111. The second blocking wall 113 may secondarily block a part of water introduced into the inlet 111. Through this process, only a part of water introduced into the housing 130 through the water supply part 131 may be introduced into the detergent container 110 through the inlet 111. Even when high-pressure water is injected into the housing 130 from the water supply part 131, the pressure of water introduced into the inlet 111 may not be high by the first blocking wall 122 and the second blocking wall 113. Therefore, water splash or overflow caused by high-pressure water introduced into the detergent container 110 may be prevented.

Referring to FIG. 10, the housing 130 may include the first guide wall 132 and the second guide wall 133 to guide water introduced into the water supply part 131 to the inlet 111. The guide bottom wall 136 may be provided between the first guide wall 132 and the second guide wall 133. The first guide wall 132 and the second guide wall 133 may guide the water introduced into the water supply part 131 to the inlet 111. A space may be provided between the first guide wall 132 and the lower surface of the housing cover 120. Therefore, a part of the water introduced into the water supply part 131 may be guided by the first guide wall 132 and the second guide wall 133 and pass through the first blocking wall 122 and then move toward the inlet 111, and the remaining part may be discharged into the space between the first guide wall 132 and the lower surface of the housing cover 120. The water discharged into the space between the first guide wall 132 and the lower surface of the housing cover 120 may move to the discharge port 135 without passing through the detergent container 110.

The housing 130 may include the detergent container groove 134 in which at least a portion of the detergent container 110 is inserted. The detergent container groove 134 may be formed in a shape corresponding to the portion of the detergent container 110. As the detergent container 110 is seated in the detergent container groove 134, the guide bottom wall 136 and the lower surface of the detergent container 110 adjacent to the inlet 111 may be located on the same surface. Alternatively, the lower surface of the detergent container 110 may be positioned lower than the guide bottom wall 136. However, when the lower surface of the detergent container 110 is positioned too lower than the guide bottom wall 136, a gap between the second blocking wall 113 and the guide bottom wall 136 is reduced, so that the amount of water introduced into the inlet 111 may be excessively reduced. Therefore, it may be appropriate that the lower surface of the detergent container 110 adjacent to the inlet 111 and the guide bottom wall 136 are provided at substantially the same height.

Figure 11:
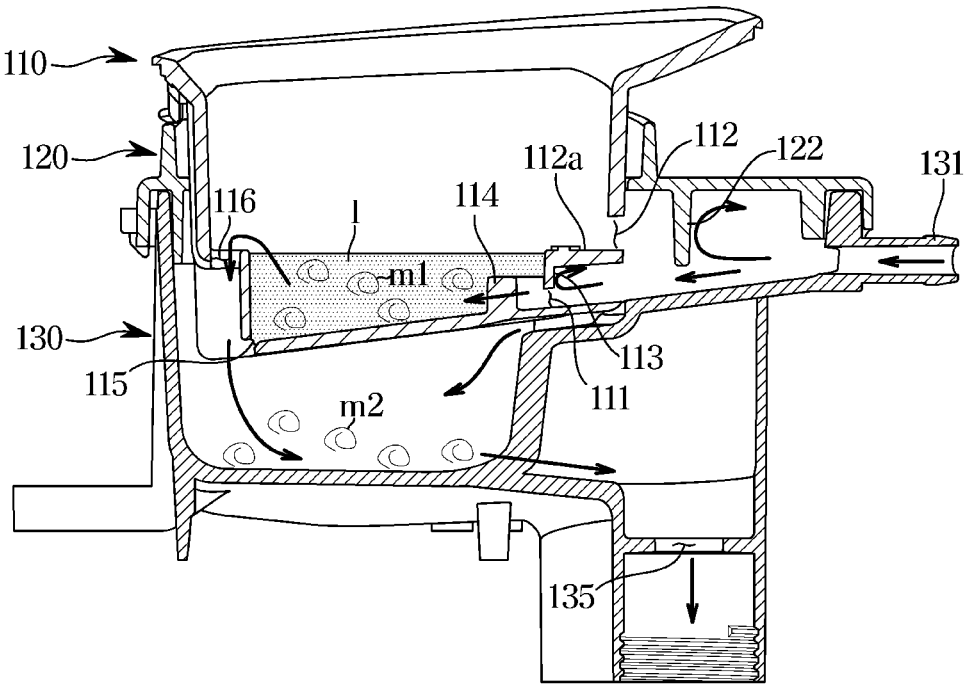
FIG. 11 is a view for explaining water supply and drainage processes of the detergent supply device when a liquid detergent is put in the detergent container, in the washing machine according to an embodiment of the disclosure.

FIG. 11 is a view for explaining water supply and drainage processes of the detergent supply device when a liquid detergent is put in the detergent container, in the washing machine according to an embodiment of the disclosure.

Water supply and drainage processes of the detergent supply device according to an embodiment of the disclosure will be described in detail with reference to FIG. 11.

When a liquid detergent I is put into the detergent container 110, water introduced into the housing 130 from an external water supply source through the water supply part 131 may be guided to the inlet 111 by the first guide wall 132 and the second guide wall 133. In the process of moving to the inlet 111, a part of the water is not introduced into the detergent container 110 by the first blocking wall 122, but may pass through the housing 130 through another path and be discharged to the discharge port 135. A part of the water passed through the first blocking wall 122 is not introduced into the detergent container 110 by the second blocking wall 113, but may pass through the housing 130 through another path and be discharged to the discharge port 135. The water introduced into the detergent container 110 through the inlet 111 may be primarily mixed with the liquid detergent I in the detergent container 110 (m1). The level of the liquid detergent I, which is primarily mixed with water, increases due to the inflow of water. Accordingly, the water and liquid detergent I may be discharged to the outside of the detergent container 110 through the outlet 116.

The water and liquid detergent I discharged through the outlet 116 may be secondarily mixed in the housing 130 (m2). As described above, a part of the water introduced through the water supply part 131 is not introduced into the detergent container 110 by the first blocking wall 122 and the second blocking wall 113, but may be discharged into the housing 130 through another path. As the water not introduced into the detergent container 110 and the water discharged from the detergent container 110 and the detergent are secondarily mixed (m2), the detergent may be sufficiently mixed with water before being supplied to the tub. As such, the washing effect may be improved by sufficiently mixing the detergent with water.

Figure 12:
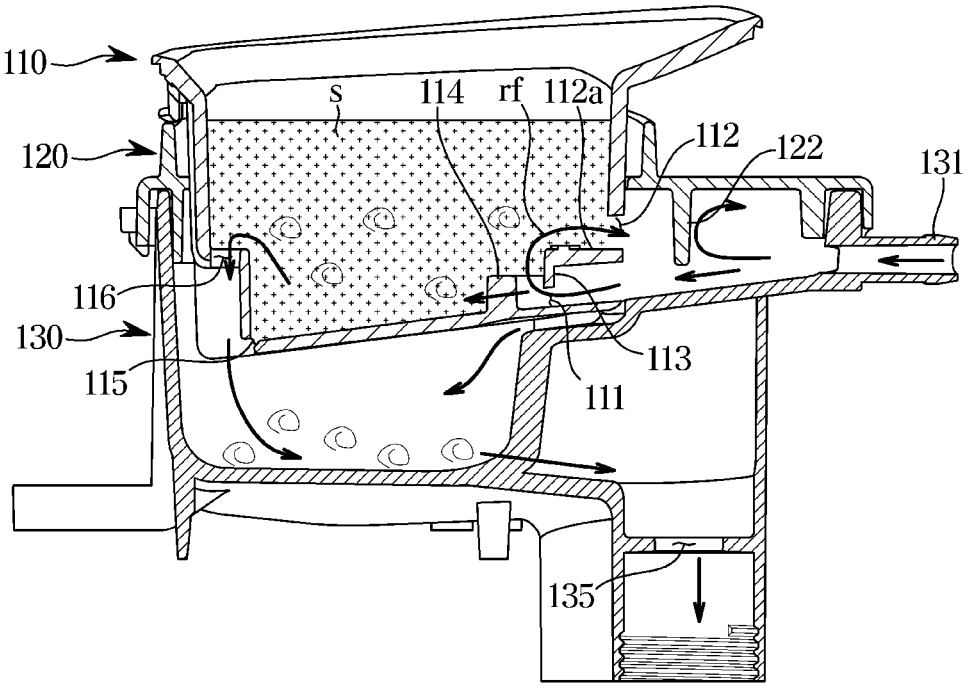
FIG. 12 is a view for explaining water supply and drainage processes of the detergent supply device when a solid detergent is put in the detergent container, in the washing machine according to an embodiment of the disclosure.

FIG. 12 is a view for explaining water supply and drainage processes of the detergent supply device when a solid detergent is put in the detergent container, in the washing machine according to an embodiment of the disclosure.

According to an embodiment of the disclosure, when a solid detergent s in powder form is put into the detergent container 110, water overflow in the detergent container 110 may be prevented.

As described above, the detergent container 110 may include the overflow hole 112. When a large amount of the solid detergent s is put into the detergent container 110 to be higher than the maximum detergent storage level indicating surface 112*a*, water introduced into the detergent container 110 is not discharged through the outlet 116 and may overflow through the open upper side of the detergent container 110. As such, when the water and solid detergent s overflow to the outside of the detergent container 110 through an unintended path, the washing machine 1 may malfunction or fail.

According to an embodiment of the disclosure, the detergent container 110 may include the overflow hole 112 adjacent to the inlet 111 and disposed above the maximum detergent storage level indicating surface 112*a*. As illustrated in FIG. 12, even when a large amount of the solid detergent s is put into the detergent container 110, the water introduced through the inlet 111 may move upward and then be discharged to the outside of the detergent container 110 through the overflow hole 112. The water and solid detergent s discharged to the outside of the detergent container 110 through the overflow hole 112 may be introduced through the inlet 111 again. This is called a recovery flow path rf. The solid detergent s and water are not discharged to the outside of the detergent container 110 through the upper side of the detergent container 110 by the recovery flow path rf and may be discharged to the outside of the detergent container 110 through the outlet 116 along the flow path intended by the designer.

As described above, even when the solid detergent s is put, the water and the solid detergent s may be primarily mixed inside the detergent container 110, and the water not introduced into the detergent container 110 in the housing 130 and the solid detergent s discharged from the detergent container 110 may be secondarily mixed. As such, the water and the solid detergent s may be sufficiently mixed in the detergent container 110 and the housing 130, so that the washing effect may be improved.

Figure 13:
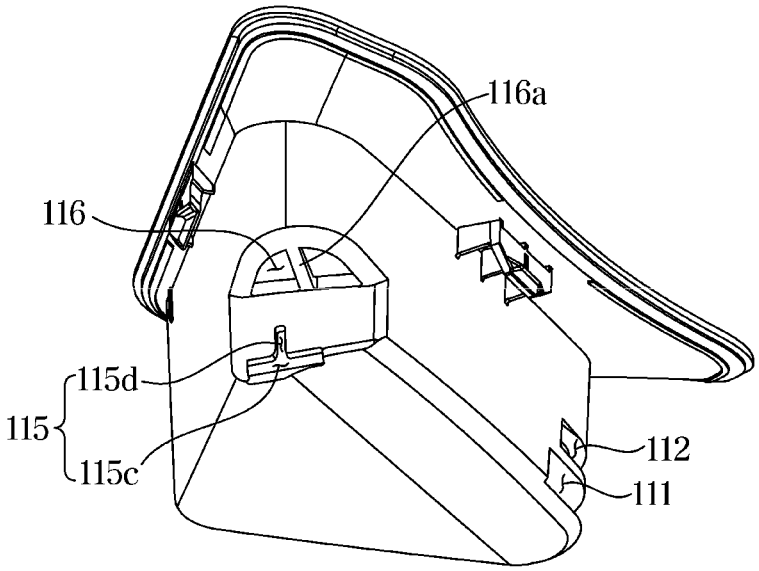
FIG. 13 is a perspective view of a detergent supply device in a washing machine according to another embodiment of the disclosure.

FIG. 13 is a perspective view of a detergent supply device in a washing machine according to another embodiment of the disclosure.

According to another embodiment of the disclosure, the detergent container 100 may include the slit 115 having a different shape from the slit described above. The slit 115 may include a first slit 115*c* extending in a horizontal direction and a second slit 115*d* extending in a vertical direction. In this case, the second slit 115*d* is not disposed at one of opposite ends of the first slit 115*c*, but may be disposed in the center of the first slit 115*c* or adjacent to the center.

As described above, when the slit 115 includes the second slit 115*d* extending in the vertical direction, water formed on the second slit 115*d* may be affected by gravity, so that the surface tension may be broken. When the surface tension of water formed on the slit 115 is broken by the second slit 115*d*, the residual water inside the detergent container 110 may be discharged through the slit 115. Therefore, the residual water inside the detergent container 110 may be discharged through the slit 115, and the residual water may be prevented from being collected in the detergent container 110.

As is apparent from the above, according to an embodiment of the disclosure, a washing machine including a detergent supply device capable of preventing a detergent and water from overflowing to the outside of a detergent container can be provided.

According to an embodiment of the disclosure, a washing machine including a detergent supply device capable of using a solid detergent as well as a liquid detergent can be provided.

According to an embodiment of the disclosure, a washing machine including a detergent supply device capable of visually recognizing an input amount of detergent to a user by delaying the time that a liquid detergent is discharged to the outside of a detergent container when the liquid detergent is put into the detergent container can be provided.

According to an embodiment of the disclosure, a washing machine including a detergent supply device capable of improving the washing effect by sufficiently mixing a detergent put in a detergent container with water before being supplied into a drum can be provided.

While the disclosure has been particularly described with reference to exemplary embodiments, it should be understood by those of skilled in the art that various changes in form and details may be made without departing from the spirit and scope of the disclosure.

What is claimed is:

1. A washing machine comprising:

a main body;

a tub disposed in the main body; and a detergent supply device configured to supply a detergent to the tub and to receive water introduced from a water supply source at a position lower than a level of the detergent in the detergent supply device, the water supply source being an external water supply source, and the detergent supply device further comprises:

a detergent container configured to contain the detergent;

a housing comprising a water supply part to receive water from the external water supply source, and configured to guide the water received through the water supply part to the detergent container; and a housing cover comprising a detergent container hole to receive the detergent container, and configured to cover an open upper side of the housing, an inlet through which the water is introduced from an outside of the detergent supply device;

a first outlet configured to delay discharge of detergent injected into the detergent supply device to the outside of the detergent supply device so that a time taken to discharge the detergent is increased; and a second outlet configured to discharge the detergent injected into the detergent supply device and the water introduced into the detergent supply device through the inlet, wherein the first outlet is formed below the second outlet so that the detergent injected into the detergent supply device which is not discharged by the second outlet is discharged by the first outlet, and residual water inside the detergent supply device is discharged to the outside of the detergent supply device.

2. The washing machine according to claim 1, wherein the first outlet comprises a first slit extending in a first direction, and a second slit extending in a second direction crossing the first direction to prevent residual water from remaining in the detergent supply device.

3. The washing machine according to claim 2, wherein the first direction along which the first slit extends is a horizontal direction and the second direction along which the second slit extends is a vertical direction, and a length of the first slit is longer than a length of the second slit.

4. The washing machine according to claim 1, wherein the second outlet is larger than the first outlet and is disposed higher than the first outlet.

5. The washing machine according to claim 1, wherein the water introduced via the inlet is supplied into the detergent container;

the first outlet is configured to delay discharge of the detergent into the detergent container to thereby increase a time taken to discharge the detergent contained in the detergent container to an outside of the detergent container; and the second outlet is formed larger than the first outlet to discharge the detergent contained in the detergent container and the water introduced into the detergent container to the outside of the detergent container.

6. The washing machine according to claim 5, wherein the detergent container further comprises a maximum detergent storage level indicating surface indicating a maximum storage level of the detergent to be contained in the detergent container, and the second outlet is disposed above the maximum detergent storage level indicating surface.

7. The washing machine according to claim 6, wherein the detergent container further comprises an outlet divider configured to divide the second outlet into a predetermined size or less to prevent foreign matters larger than the predetermined size from being discharged through the second outlet.

8. The washing machine according to claim 5, wherein the detergent container further comprises a distribution guide disposed adjacent to the inlet to guide water introduced into the detergent container through the inlet in two different directions.

9. The washing machine according to claim 5, wherein the housing cover further comprises a blocking wall configured to block a part of water guided from the water supply part to the inlet.

10. The washing machine according to claim 9, wherein the blocking wall is a first blocking wall, and the detergent container further comprises:

a second blocking wall configured to block a part of water passing through the first blocking wall and introduced into the inlet.

11. The washing machine according to claim 5, wherein the housing further comprises a first guide wall configured to guide water introduced into the housing through the water supply part to the inlet, and a second guide wall spaced apart from the first guide wall by a predetermined distance.

12. The washing machine according to claim 5, wherein the detergent contained in the detergent container is primarily mixed with the water introduced into the detergent container through the inlet, and discharged to the outside of the detergent container together with the water introduced into the inlet through the second outlet and then secondarily mixed with the water in the housing.

13. The washing machine according to claim 5, wherein the detergent container further comprises an overflow hole disposed adjacent to the inlet and positioned higher than a maximum detergent storage level indicating surface, and when a solid detergent is injected into the detergent container, the water introduced into the detergent container through the inlet is discharged to the outside of the detergent container together with the solid detergent through the overflow hole.

14. The washing machine according to claim 13, wherein the water and the solid detergent discharged through the overflow hole are reintroduced into the detergent container through the inlet.

* * * * *